US006041506A

United States Patent [19]

Iwao

[11] Patent Number: 6,041,506

[45] Date of Patent: Mar. 28, 2000

[54] HOLE-FORMING DEVICE

[75] Inventor: Shin Iwao, Gunma-ken, Japan

[73] Assignees: Shin IWAO; Kabushiki Kaisha Iwazaki, both of Japan

[21] Appl. No.: 09/199,365

[22] Filed: Nov. 25, 1998

[30] Foreign Application Priority Data

Nov. 6, 1998 [JP] Japan ..... 10-316547

[51] Int. Cl.[7] ..... B67B 7/24

[52] U.S. Cl. ..... 30/443; 30/400; 83/660; 141/65; 220/89.3; 222/81; 222/87

[58] Field of Search ..... 413/78; 220/89.3, 220/89.2; 83/660; 30/443, 400, 414; 222/87, 81, 80; 141/65

[56] References Cited

U.S. PATENT DOCUMENTS

| | | | |
|---|---|---|---|
| 2,222,703 | 11/1940 | Bixler | 220/89.3 |
| 2,336,490 | 12/1943 | Vico | 220/89.3 |
| 4,550,621 | 11/1985 | Rush | 83/660 X |
| 4,620,576 | 11/1986 | Owen, Jr. | 30/400 X |
| 5,086,814 | 2/1992 | Sato et al. | 141/65 |
| 5,740,615 | 4/1998 | Treske | 30/443 X |

*Primary Examiner*—James F. Coan
*Attorney, Agent, or Firm*—Morrison Law Firm

[57] ABSTRACT

A hole-forming device includes a pointed shaft which is raisable to a position facing a bottom of a can. The shaft is slidably supported on a support plate, with its lower end projecting downward below the support plate. With the hole-forming device mounted on the bottom of the can, and the bottom of the hole-forming device on a surface, such as a floor, a downward force on the can urges the pointed end of the shaft into the bottom of the can to safely puncture the can.

9 Claims, 14 Drawing Sheets

Fig. 2 (A)
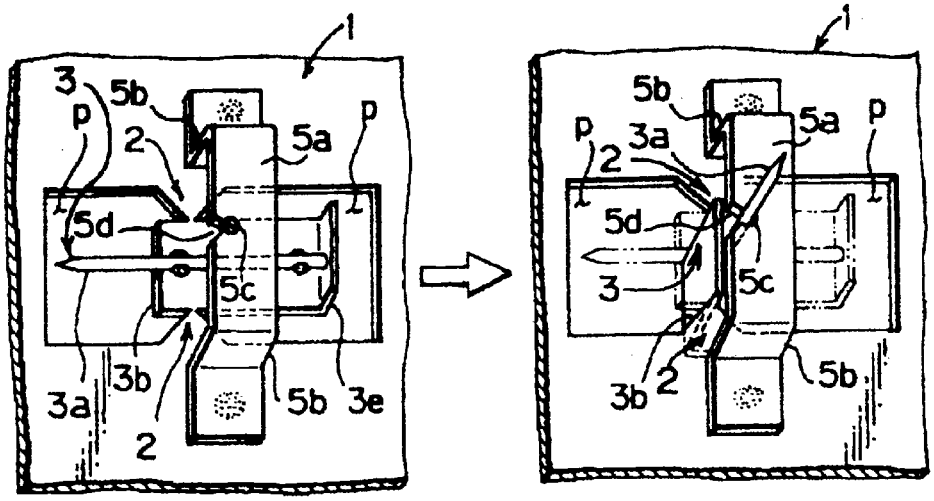
Fig. 2 (B)
Fig. 2 (C)
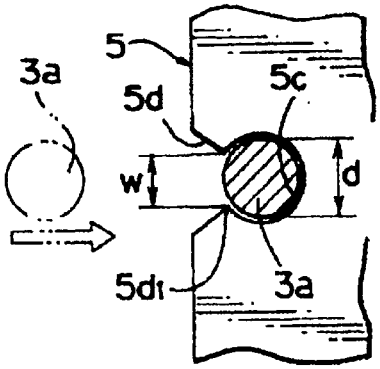
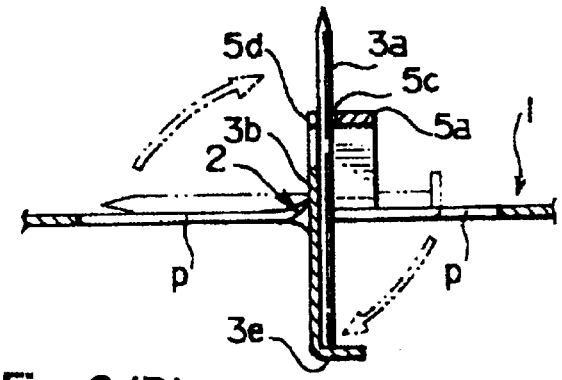
Fig. 2 (D)
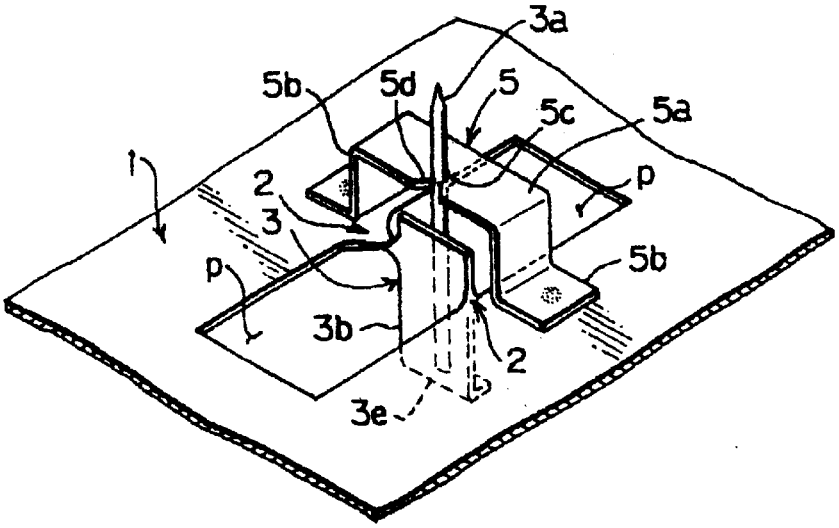

HOLE-FORMING DEVICE

BACKGROUND OF THE INVENTION

The present invention relates to a hole-forming device for cans that allows holes to be formed in a safe and reliable manner for cans used for spraying their contents such as spray cans, gas tank cartridges for stoves, and the like. When these containers are to be discarded, these holes are formed as vent holes to release residual gas.

When discarding spray cans, gas tank cartridges for stoves, and the like, after use, residual gas inside the container may not be completely discharged. This residual gas is often left inside the container when it is discarded. This is extremely dangerous for workers during the disposal operation, and can also have a negative impact on the environment.

For these reasons, various devices have been developed to form gas venting holes in cans so that the gas in containers can be discharged. Many of these form a gas venting hole for discharging residual gas by puncturing a side surface or a bottom surface of a container using a plate material or the like having a nail, a needle, or a sharpened end. This type of device has been the most common.

As described above, many of the dedicated devices used to form gas venting holes for the discharge of gas from used containers involves a sharp end, i.e., a nail-shaped end. However, when forming holes with a nail-shaped member, the puncturing of the container with the nail-shaped member is dangerous.

In particular, since a can is cylindrical in shape, its side surface is a curved side surface. Also, the bottom surfaces are almost always formed as a concave spherical surface. Thus, when a tool having a nail-shaped member is to be driven into a container to puncture it, the end of the nail-shaped member can very easily slip along the side surface of the container if it is driven at an orientation that is even slightly shifted from a perpendicular orientation. This makes forming, a gas venting hole difficult.

Of course, if the end of the nail-shaped member slips when it is being driven in, this is also dangerous for the worker performing the operation. Thus, when forming a gas venting hole in a can using a tool having a nail-shaped member, the nail-shaped member must be kept in a fixed and stable state. Among the various hole-forming devices, almost none take this issue into consideration.

OBJECTS AND SUMMARY OF THE INVENTION

It is an object of the invention to provide a hole forming device which overcomes the drawbacks of the prior art.

As a result of diligent research into this problem, the present inventor has found a safe and reliable way to form gas vent holes for cans and was able to overcome the problems described above by providing a hole-forming device that includes a support plate removable relative to a bottom of a can and having a cut-out opening formed at a roughly central position. A hole-forming body is formed within the cut-out opening of the support plate and is capable of being raised from an orientation co-planar with the surface of the support plate to a roughly perpendicular orientation. Two twistable connecting pieces connect the hole-forming body and the support plate. A hole-formation support slidably supports the hole-forming body in a raised state at a position separated from the surface of the support plate. When the hole-forming body is in a raised state, a lower side of the hole-forming body is projected from the surface of the support plate.

Briefly stated, the present invention provides a hole-forming device which includes a pointed shaft that is raisable to a position facing a bottom of a can. The shaft is slidably supported on a support plate, with its lower end projecting downward below the support plate. With the hole-forming device mounted on the bottom of the can, and the bottom of the hole-forming device contacting a surface, such as a floor, a downward force on the can urges the pointed end of the shaft into the bottom of the can to safely puncture the can.

According to an embodiment of the invention, there is provided a hole-forming device comprising a support plate fittable to a bottom of a can said support plate having a cut-out opening formed therein a hole-forming body formed within said cut-out opening of said support plate, deformable means for permitting raising of said hole-forming body from an orientation co-planar with the surface of said support plate to a roughly perpendicular orientation said deformable means including at least first and second twistable connecting pieces connecting said hole-forming body and said support plate, and a hole-formation support slidably supporting said hole-forming body in a raised state at a position separated from the surface of said support plate, and when said hole-forming body is in a raised state, a lower side of said hole-forming body projects beyond a surface of said support plate, whereby a lower part of said hole-forming body is available to receive a force effective to urge said hole-forming body upward into piercing contact with a bottom of said can.

According to a feature of the invention, there is provided a hole-forming device comprising, a support plate fittable to a bottom of a can, said support plate having a cut-out opening therein a hole-forming body formed within said cut-out opening of said support plate, means for permitting said hole-forming body to be raised from an orientation co-planar with the surface of said support plate to a roughly perpendicular orientation a hole-forming shaft a shaft support plate, two twistable connecting pieces connecting said shaft support plate and said support plate a hole-formation support slidably supporting said hole-forming body in a raised state at a position separated from the surface of said support plate said hole-forming shaft is slidably disposed on said shaft support plate and when said hole-forming body is in a raised state, a lower end of said hole-forming shaft projects below a lower surface of said support plate.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 (B) is a schematic perspective drawing of a hole-forming device.

FIG. 1 (C) is a cross-section drawing showing a hole-forming device mounted to the bottom of a can.

FIG. 2 (A) shows the process of raising the hole-forming body to a perpendicular orientation relative to the support plate.

FIG. 2 (B) is a detail drawing showing how the hole-forming shaft is inserted through the bearing hole of the hole-forming support section.

FIG. 2 (C) is a schematic cross-section drawing showing the hole-forming shaft raised to a roughly perpendicular orientation.

FIG. 2 (D) is a schematic perspective drawing showing the hole-forming shaft raised to a roughly perpendicular orientation.

FIG. 3 (B) is a plan drawing of a hole-forming device.

FIG. 3 (C) is a drawing showing the hole-forming operation.

FIG. 4 (B) is a drawing showing how a gas vent hole is formed at the bottom of a can.

FIG. 5 (B) is a schematic perspective drawing showing the hole-forming body in a raised state.

FIG. 5 (C) is a schematic perspective drawing showing the deformation section of the twistable connecting piece deformed and the twistable connecting piece extended.

FIG. 6 (B) is a schematic perspective drawing showing the deformation section of the twistable connecting piece deformed and the twistable connecting piece extended.

FIG. 7 (B) is a schematic perspective drawing showing the hole-forming body in a raised state.

FIG. 7 (C) is a schematic perspective drawing showing the deformation section of the twistable connecting piece deformed and the twistable connecting piece extended.

FIG. 7 (D) is a schematic perspective drawing of a hole-forming body according to yet another alternative example where the twistable connecting piece has a deformation section.

FIG. 8 (B) is a schematic perspective drawing of the second embodiment of the present invention showing the hole-forming body raised in a roughly perpendicular orientation.

FIG. 8 (C) is a schematic plan drawing showing a partial cross-section of the second embodiment of the present invention.

FIG. 9 (B) is a drawing showing the completion of the formation of the gas venting hole on the can.

FIG. 10 (B) is a schematic perspective drawing showing the hole-forming body from the third embodiment raised to a roughly perpendicular orientation.

FIG. 10 (C) is an enlarged perspective drawing showing the hole-forming section of the third embodiment.

FIG. 10 (D) is an end-view drawing along the X—X line.

FIG. 11 (B) is a drawing showing the completion of the formation of the gas venting hole at the bottom of the can.

FIG. 12 (B) is a perspective drawing showing an alternative example of the third embodiment where the hole-forming body is raised to a roughly perpendicular orientation.

FIG. 13 (B) is a schematic perspective drawing of the fourth embodiment where the hole-forming device is raised to a roughly perpendicular orientation.

FIG. 13 (C) is a schematic cross-section drawing of the fourth embodiment where the hole-forming device is raised to a roughly perpendicular orientation.

FIG. 14 (B) is a drawing showing how the formation of the gas vent hole at the bottom of the can is completed.

DETAILED DESCRIPTION OF THE PREFERRED EMBODIMENTS

Figure 1:
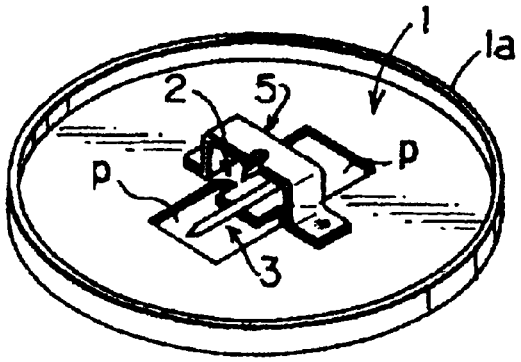
FIG. 1 (A) is a perspective drawing of a hole-forming device.
Figure 1:
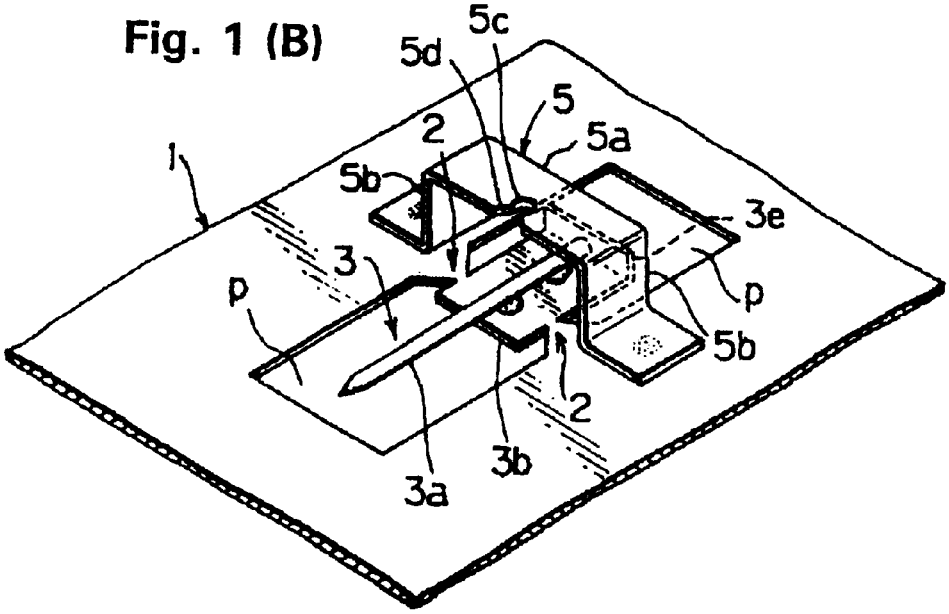
Figure 1:
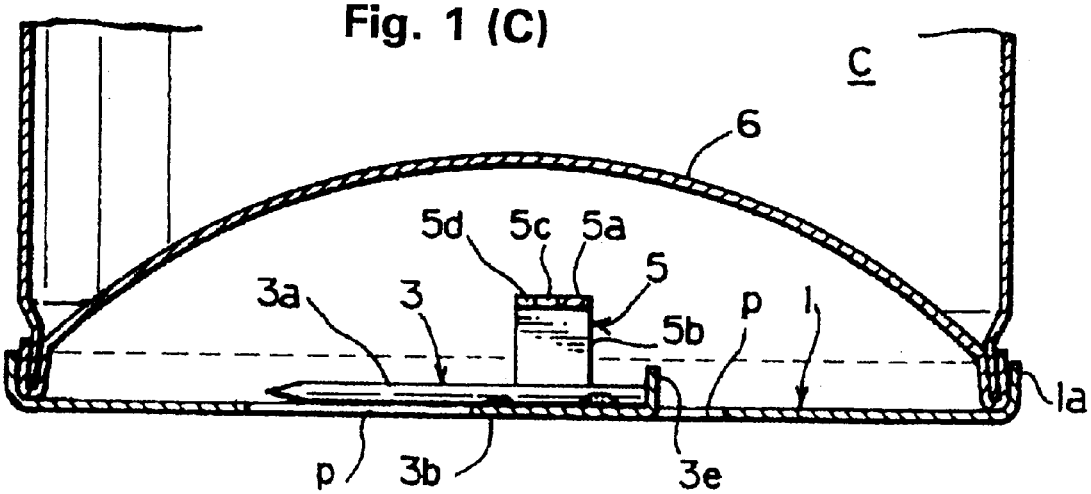

Referring to the drawings, the following is a description o1 the embodiments of the present invention. Various embodiments exist for the present invention. Referring to FIG. 1 (A), (B), the first embodiment is composed essentially of a support plate 1, a hole-forming body 3, and a hole-formation support 5. The support plate 1 is formed as a circular plate having a raised outer perimeter 1*a*.

When the support plate 1 is mounted on a bottom 6 of a can C, the raised edge 1*a* can be fitted to the perimeter edge of the bottom 6 of the can C. To facilitate describing the structure, the side of the support plate 1 on which the raised edge 1*a* is formed will be referred to as "the mounting surface" that will be mounted to the bottom 6 of the can C, while the opposite side will be referred to as "the operating surface".

A cut-out opening p is formed at a roughly central position of the support plate 1. Inside the cut-out opening p is formed the hole-forming body 3. More specifically, the cut-out opening p is formed in a roughly rectangular shape having a width or shape that allows the hole-forming body 3 formed inside the cut-out opening p to be easily raised roughly perpendicular to the support plate 1.

The hole-forming body 3 of the cut-out opening p is connected to support plate 1 via twistable connecting pieces 2, 2. Referring to FIG. 2 (A) and (C), The hole-forming body 3 can be moved from a state where it is roughly co-planar with the surface of the support plate 1 to a roughly perpendicular raised state where the hole-forming body 3 is rotated around the twistable connecting pieces 2, 2 as the twistable connecting pieces 2, 2 are being twisted.

The twistable connecting pieces 2, 2 are formed with a width and shape that allows the support plate 1 to be easily raised relative to the support plate 1 while the connection between the hole-forming body 3 and the support plate 1 is maintained. Referring to FIG. 1 (B) and FIG. 2 (A), the twistable connecting pieces 2, 2 are formed so that they have a roughly triangular planar shape, with one side of the triangle being connected to the support plate 1 and a vertex of the triangle being connected to the hole-forming body 3.

Figure 8:
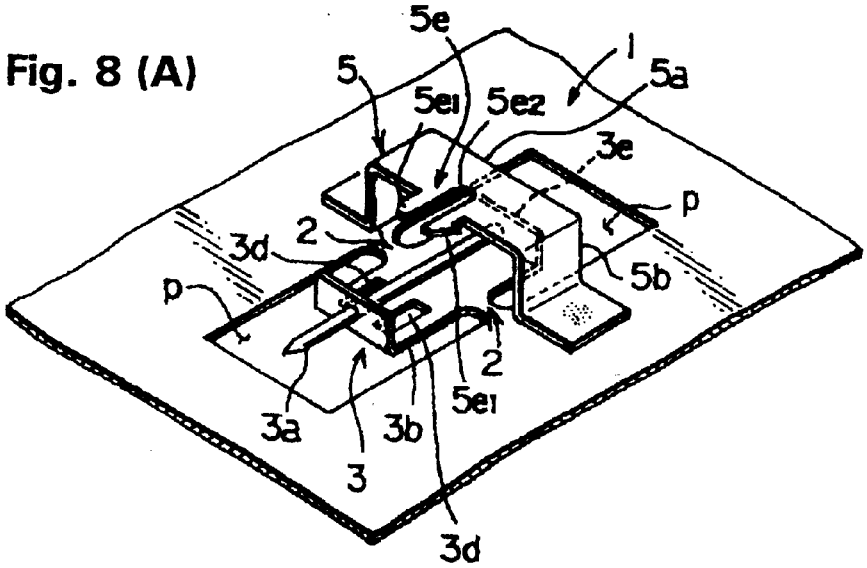
FIG. 8 (A) is a schematic perspective drawing of a hole-forming device according to the second embodiment of the present invention.
Figure 8:
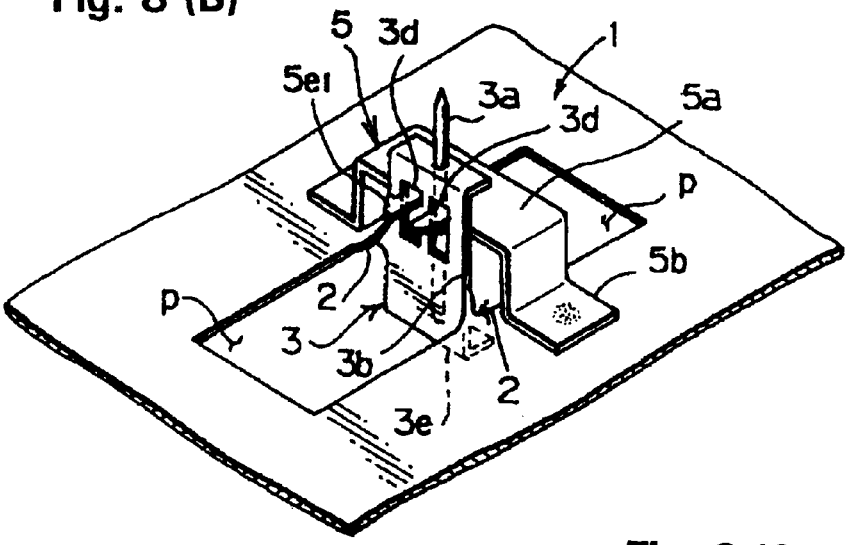
Figure 8:
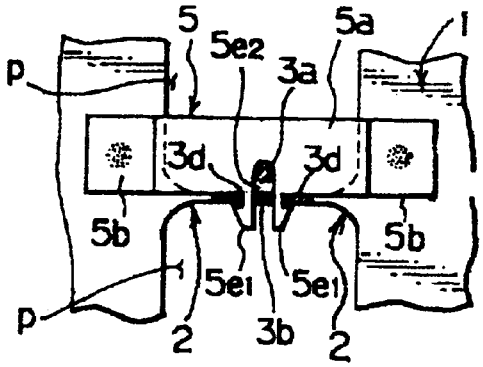

When the hole-forming body 3 is raised relative to the support plate 1, twisting takes place at the vertex of the triangle, i.e., the narrowest portion. Referring to FIG. 8 (A), (B), there is also an embodiment where the twistable connecting pieces 2, 2 have roughly U-shaped outer edges. There are no special restrictions on the twistable connecting pieces 2, 2 as long as they can be easily twisted without breaking, as described above.

The hole-forming body 3 includes a hole-forming shaft 3*a* and a shaft-supporting plate 3*b*. Referring to FIG. 1 (B) and FIG. 2 (A), the shaft-supporting plate 3*b* is formed integrally with the support plate 1 via the twistable connecting pieces 2, 2. The hole-forming shaft 3*a* is formed in the shape of a nail-shaped or a cone-shaped shaft and is fixed to the shaft-supporting plate 3*b* via spot welding (see FIG. 1 (A) and FIG. 2 (A)) or by being firmly pressed in to a bend or the like formed on the shaft-supporting plate 3*b* (see FIG. 8 (A) and (B)).

Figure 4:
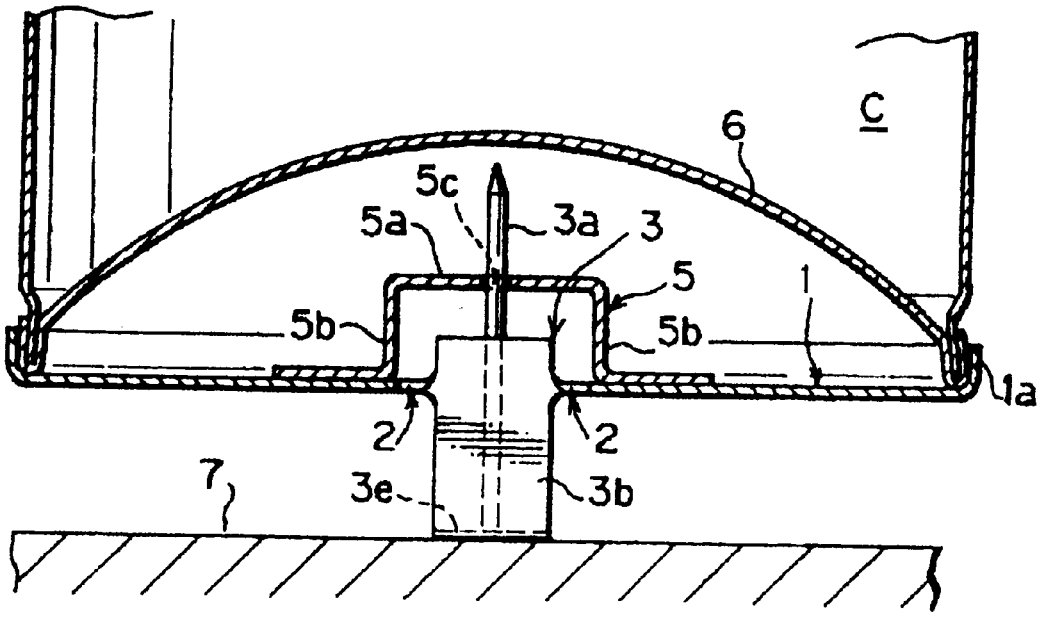
FIG. 4 (A) is a drawing showing how a gas vent hole is formed at the bottom of a can.
Figure 4:
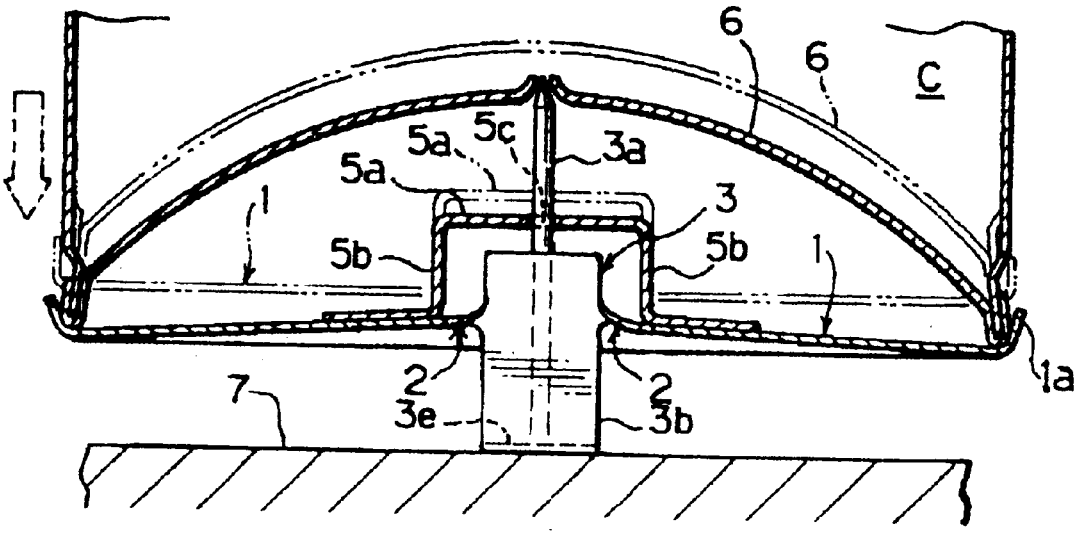

The hole-forming shaft 3*a* is raised so that it is roughly perpendicular to both the shaft-supporting plate 3*b* and the support plate 1. The twisting of the twistable connecting pieces 2, 2 generates a slight metal fatigue, facilitating plastic deformation in the shaft-supporting plate 3*b*. Referring to FIG. 4 (A) and (B), the fact that the support plate 1 is formed from a thin metal plate makes the overall hole-forming device soft, thus further facilitating the plastic deformation in the twistable connecting pieces 2, 2 and allowing easy displacement of the hole-forming body 3 to a roughly perpendicular orientation relative to the support plate 1.

Referring to FIG. 2 (C) and (D), when the hole-forming body 3 is raised roughly perpendicular relative to the support plate 1, one end of the hole-forming body 3 (the hole-forming end) is projected to the mounting surface side, and the other end (the end opposite from the hole-forming end) is projected to the operating side. The portion that projects to the operating side is referred to as a pushing section 3*e*.

The hole-formation support 5 is fixed to the support plate 1 via welding means or the like so that it extends across the cut-out opening p. Referring to FIG. 1 (B), legs 5*b*, 5*b* are formed at the lateral ends of a flat support end-plate 5*a* so that the support end-plate 5*a* and the legs 5*b*, 5*b* form a roughly arch-shaped structure. The support end-plate 5*a* is positioned at a distance away from the support plate 1 based on the height of the legs 5*b*, 5*b*.

A bearing hole 5*c*, through which the hole-forming shaft 3*a* is inserted, is formed on the support end-plate 5*a*. A cut-out section 5*d* is formed on the bearing hole 5*c* to let the hole-forming shaft 3*a* enter. The cut-out section 5*d* is formed as a roughly fan-shaped opening that is continuous with the bearing hole 5*c*.

The connecting section between the cut-out section 5*d* and the bearing hole 5*c* will be referred to as a minimum-width opening 5*d*1.

Referring to FIG. 2 (B), the width w of the opening of the minimum-width opening 5*d*1 and the diameter d of the hole-forming shaft 3*a* have the relationship d>w. The hole-forming shaft 3*a* passes through the cut-out section 5*d* and enters the bearing hole 5*c* by pushing apart the minimum-width opening 5*d*1.

Once the hole-forming shaft 3*a* enters the bearing hole 5*c*, the minimum-width opening 5*d*1 keeps the hole-forming shaft 3*a* from easily disengaging from the bearing hole 5*c*. Thus, when the hole-forming body 3 is raised at a roughly perpendicular orientation relative to the support plate 1, the hole-forming body 3 is slidably supported at the top and bottom by the twistable connecting pieces 2, 2 and the bearing hole 5*c* of the hole-formation support 5.

Figure 3:
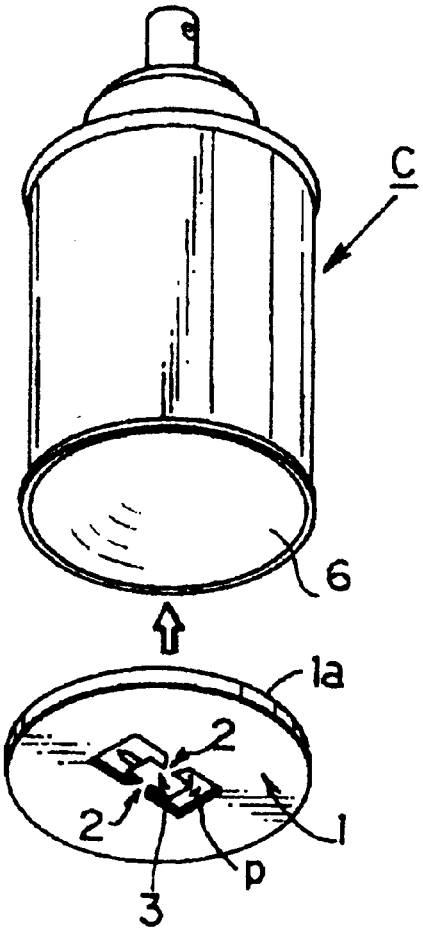
FIG. 3 (A) is a perspective drawing showing a hole-forming about to be mounted to the bottom of a can.
Figure 3:
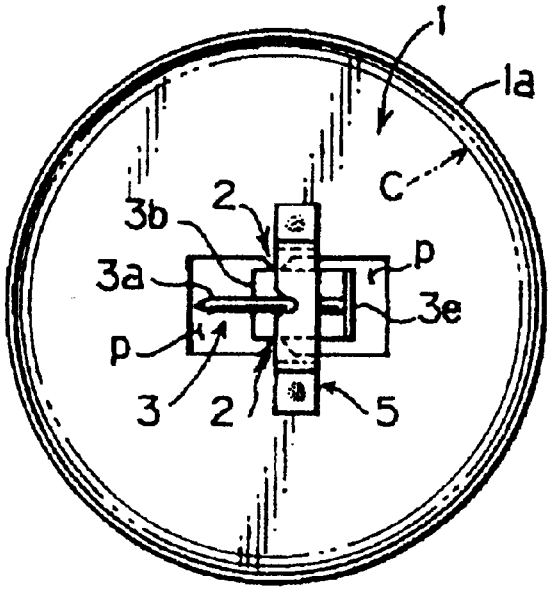
Figure 3:
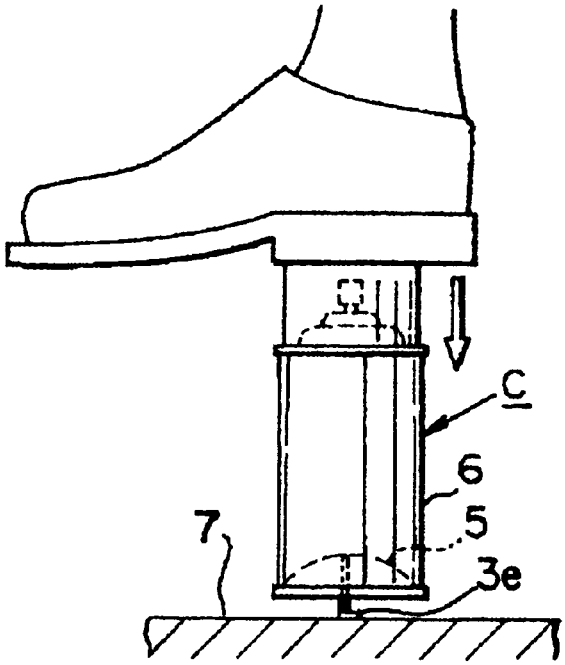

Referring to FIG. 3 (A), the hole-forming device of the present invention is mounted to the bottom 6 of the can C. The hole-forming body 3 is oriented roughly perpendicular relative to the support plate 1. The hole-forming shaft 3*a* thereof is supported by the hole-formation support 5. The section projecting toward the operating side of the support plate 1, i.e., the pushing section 3*e*, is placed in contact with a floor surface 7 and the upper portion of the can C is pushed against it.

Referring to FIG. 3 (C) and FIG. 4 (C), this causes the hole-forming body 3 to move toward the bottom 6 so that the end of the hole-forming shaft 3*a* punctures the bottom 6, forming a gas venting hole in the bottom 6.

In one embodiment, the twistable connecting pieces 2, 2 are formed with deformation sections 2*a*, 2*a*. The deformation section 2*a* has a structure that allows easy deformation. When the hole-forming body 3 is oriented roughly perpendicular to the support plate 1, the deformation section 2*a* is deformed so that the twistable connecting piece 2 can easily extend longitudinally.

Figure 5:
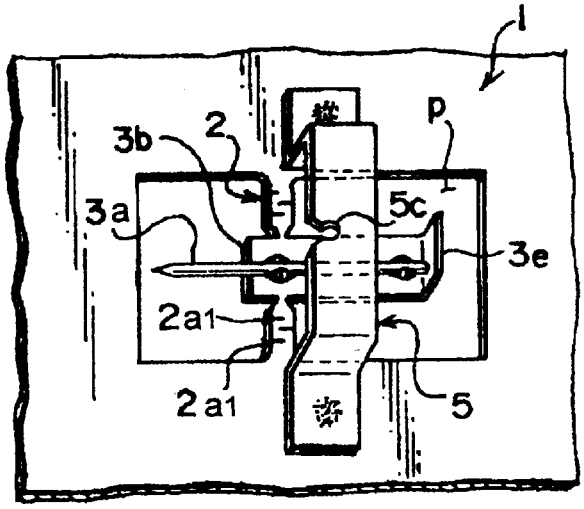
FIG. 5 (A) is a schematic plan perspective drawing showing a hole-forming device in which deformation sections are formed on twistable connecting pieces.
Figure 5:
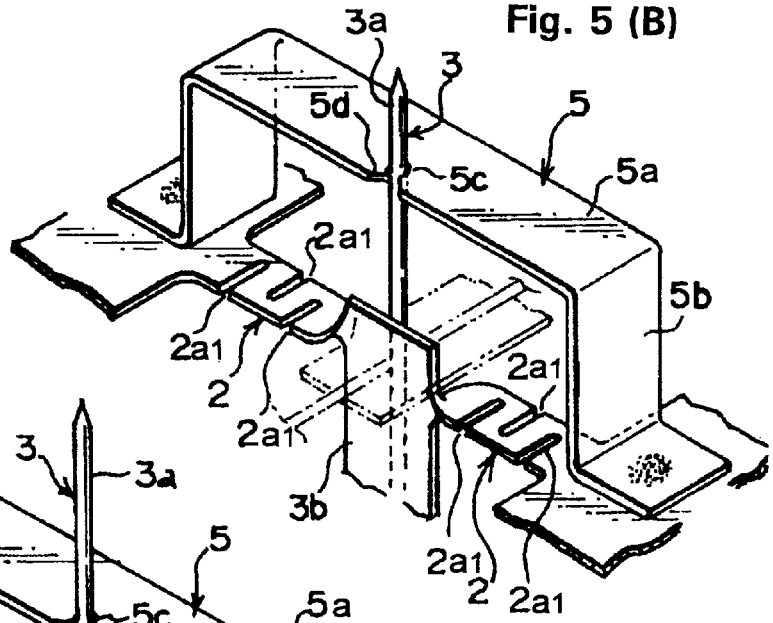
Figure 5:
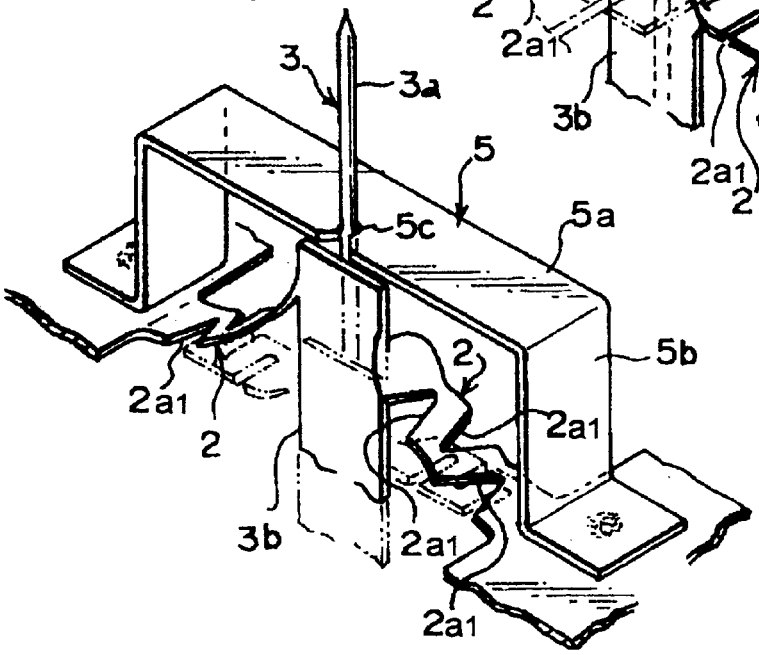

Referring to FIGS. 5 (A) and (B), the deformation section 2*a* is implemented by forming a plurality of notches 2*a*1, 2*a*1, . . . the notches 2*a*1 are oriented in a roughly perpendicular direction relative to the longitudinal axis of the twistable connecting piece 2, and the notches are alternated along the longitudinal axis of the twistable connecting piece 2.

Referring to FIG. 5 (C), when the hole-forming body 3 is oriented perpendicular to the support plate 1 to form a gas venting hole, applying pressure to displace hole-forming body 3 causes the notches 2*a*1, 2*a*1, . . . to widen so that the twistable connecting pieces 2, 2 can easily stretch longitudinally.

Figure 6:
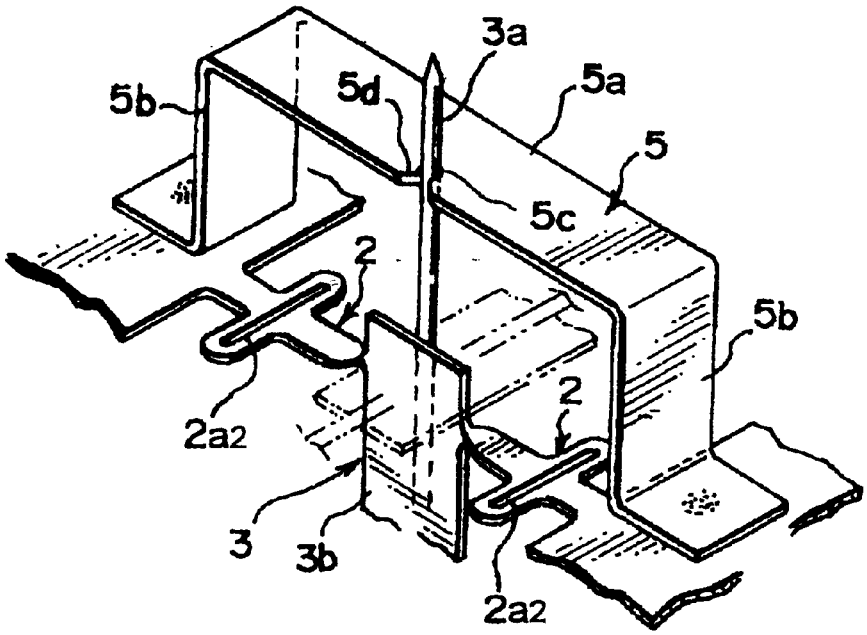
FIG. 6 (A) is a schematic perspective drawing of a hole-forming device according to an alternative example in which the twistable connecting piece has a deformation section.
Figure 6:
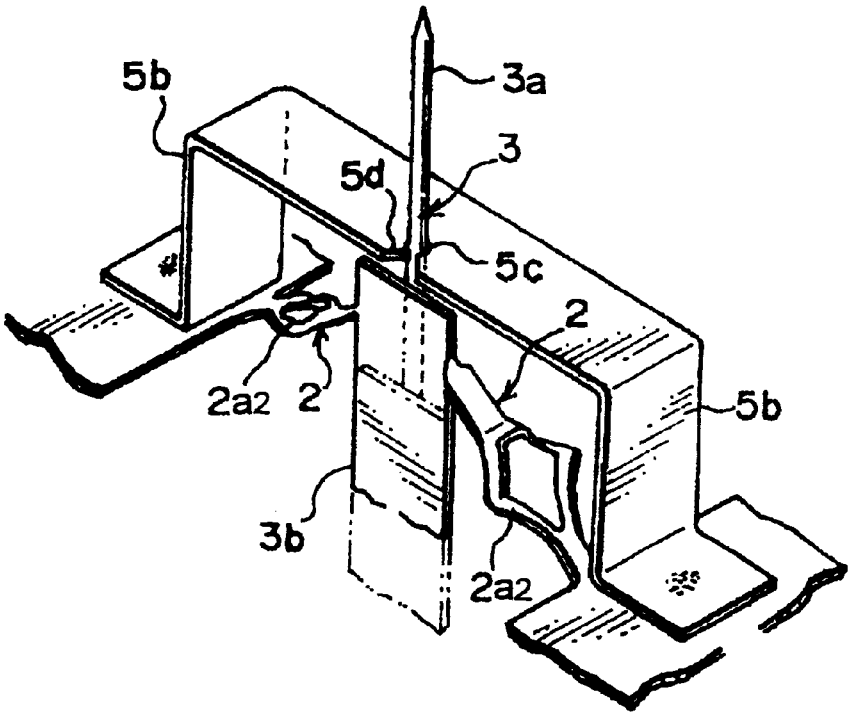

Referring to FIG. 6 (A), in a second type of deformation section 2*a*, ring-shaped sections 2*a*2, 2*a*2 are formed at roughly the longitudinal midpoints of the twistable connecting pieces 2. The ring-shaped section 2*a*2 is formed as a section of the twistable connecting piece 2 that is projected in a direction that is roughly perpendicular to the longitudinal axis of the twistable connecting piece 2. In other words, it is a laterally projecting section at an appropriate position of the twistable connecting piece 2. Inside the ring-shaped section 2*a*2 is formed a linear slot. Referring to FIG. 6 (B), when the twistable connecting piece 2 is stretched longitudinally, the linear slot formed in the ring-shaped section 2*a*2 is widened, thus facilitating the longitudinal extension of the twistable connecting piece 2.

Figure 7:
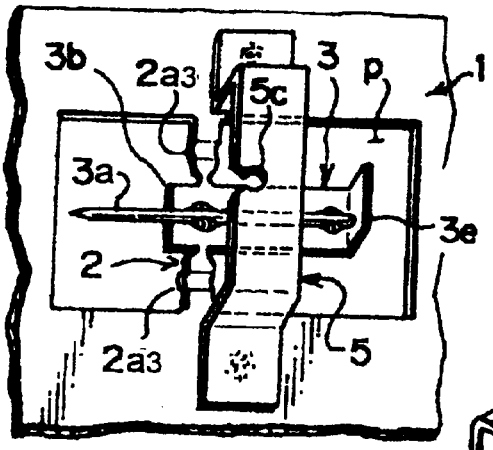
FIG. 7 (A) is a schematic plan perspective drawing of a hole-forming device according to an alternative example in which the twistable connecting piece has a deformation section.
Figure 7:
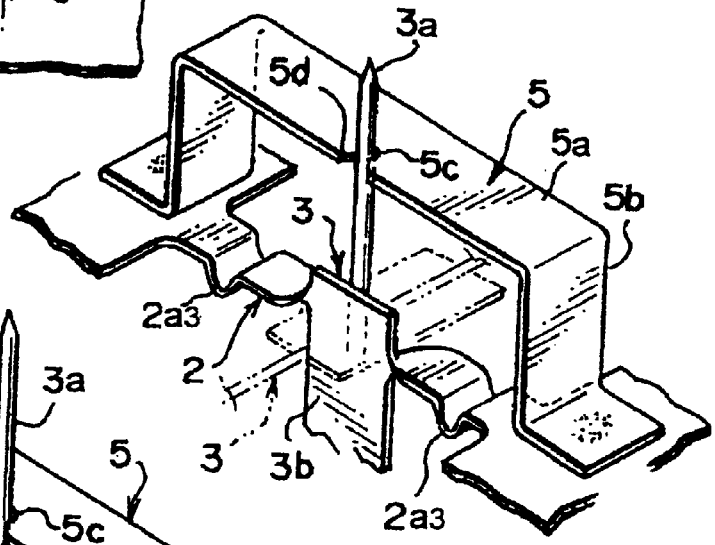
Figure 7:
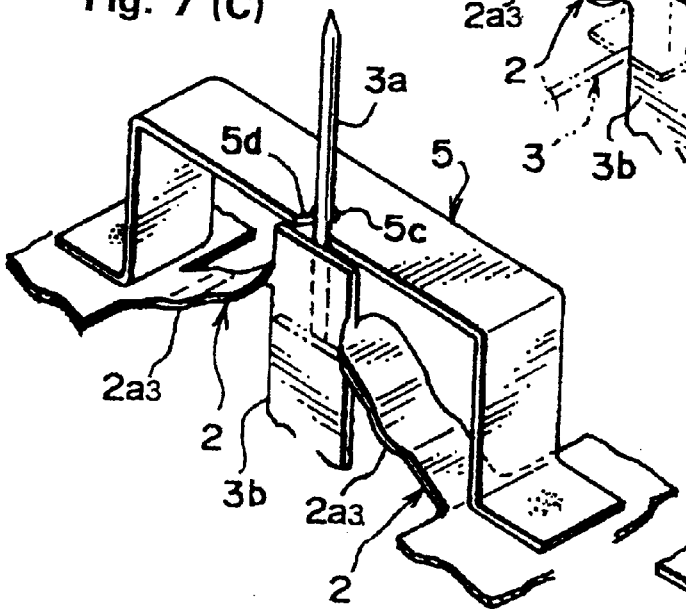
Figure 7:
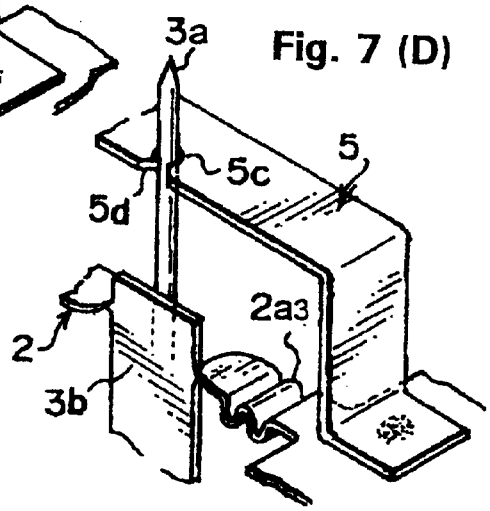

Referring to FIG. 7 (A) and (B), a third type of the deformation section is formed with meandering bends 2*a*3, 2*a*3 at positions roughly at the longitudinal midpoints of the twistable connecting piece 2. The meandering bend 2*a*3 is bent roughly in a U shape relative to the longitudinal axis of the twistable connecting pieces 2.

Referring to FIG. 7 (C), when the twistable connecting piece 2, is extended, the ring-shaped section 2*a*2 is stretched, thus facilitating the longitudinal extension of the twistable connecting piece 2. Referring to FIG. 7 (D), there is shown a structure where a meandering bend 2*a*3 is formed as two continuous bends.

Figure 9:
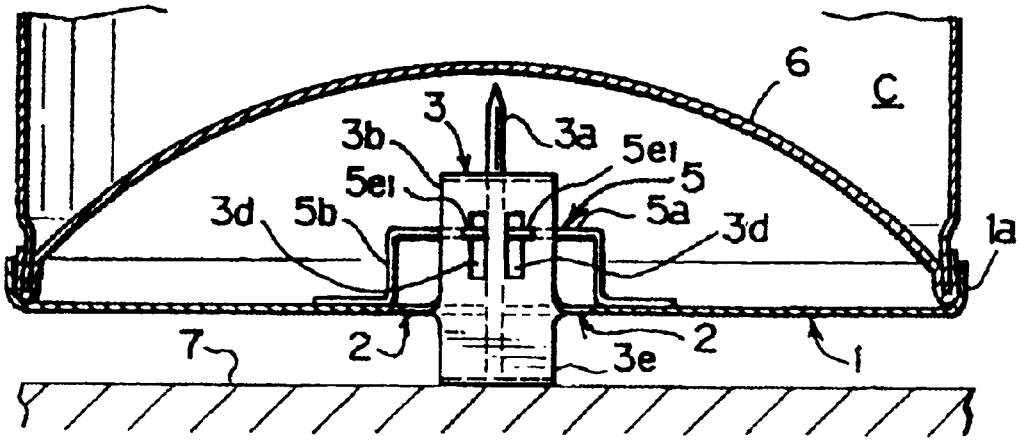
FIG. 9 (A) is a drawing showing how a gas venting hole is formed at the bottom of a can according to the second embodiment.
Figure 9:
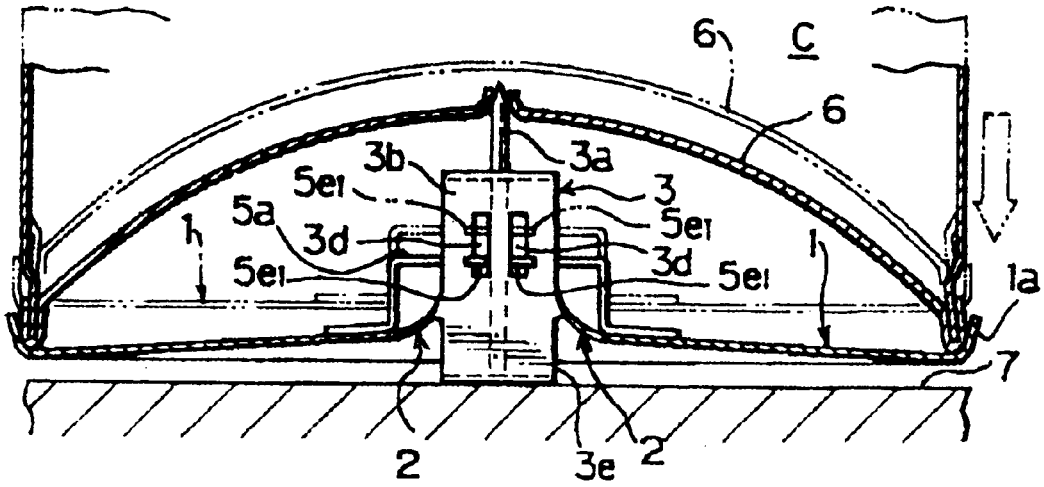

Referring to FIGS. 8 (A)–(C) and FIGS. 9 (A)–(B), the following is a description of a second embodiment of the present invention. As with the first embodiment described above, this embodiment includes a hole-forming body 3, a hole-forming shaft 3*a*, and a shaft-supporting plate 3*b*. However, the shaft-supporting plate 3*b* and the support end-plate 5*a* of the hole-formation support 5 are slidably engaged.

Referring to FIG. 8 (A) and (B), an engaging hole 3*d* is formed on shaft-supporting plate 3*b*, and an engagement projection 5*e* is formed on the support end-plate 5*a*. The engaging hole 3*d* is formed as a slot extending along the longitudinal axis of the shaft-supporting plate 3*b*. Two small projections 5*e*1, 5*e*1 are formed on the engagement projection 5*e*. A bearing groove 5*e*2, into which the hole-forming shaft 3*a* is inserted, is formed between the small projections 5*e*1, 5*e*1.

With the hole-forming body 3 raised to a perpendicular orientation relative to the support plate 1, the engagement projection 5*e* of the hole-formation support 5 is engaged with the engaging hole 3*d* of the shaft-supporting plate 3*b*, and the shaft-supporting plate 3*b* is supported in a perpendicular orientation along with the twistable connecting pieces 2, 2. Since the engaging hole 3*d* is formed as a slot, the engaging hole 3*d* and the engagement projection 5*e* engaged with the engaging hole 3*d* can move relative to each other. Referring to FIG. 9 (A) and (B), this allows the hole-forming body 3 to move in a direction roughly perpendicular relative to the support plate 1.

Figure 10:
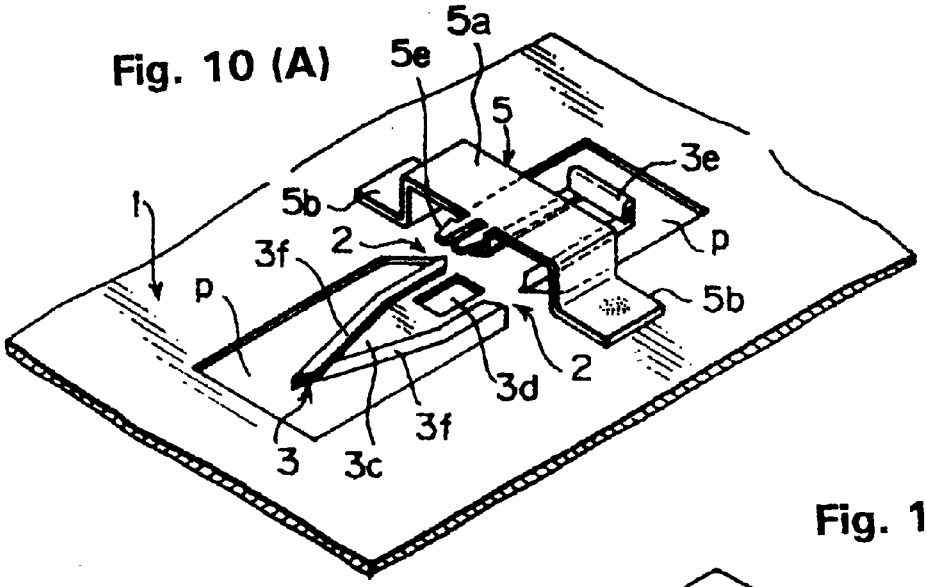
FIG. 10 (A) is a schematic perspective drawing of a hole-forming device according to the third embodiment.
Figure 10:
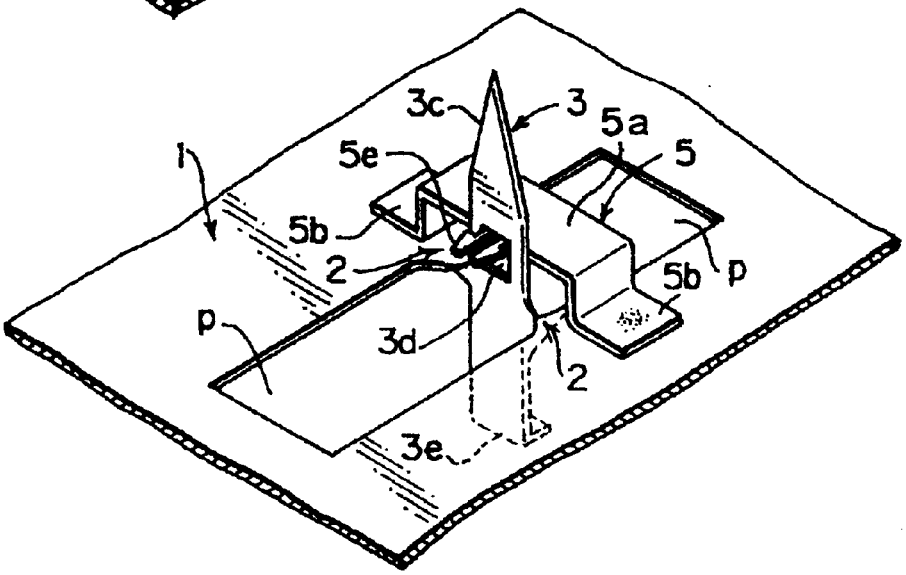
Figure 10:
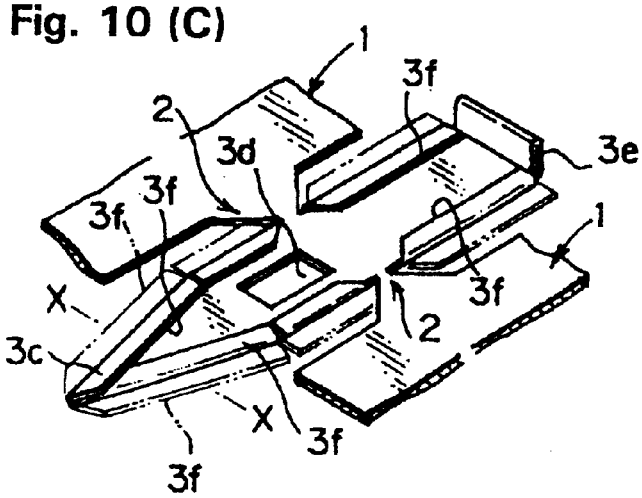
Figure 10:
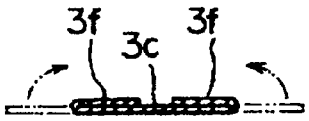
Figure 11:
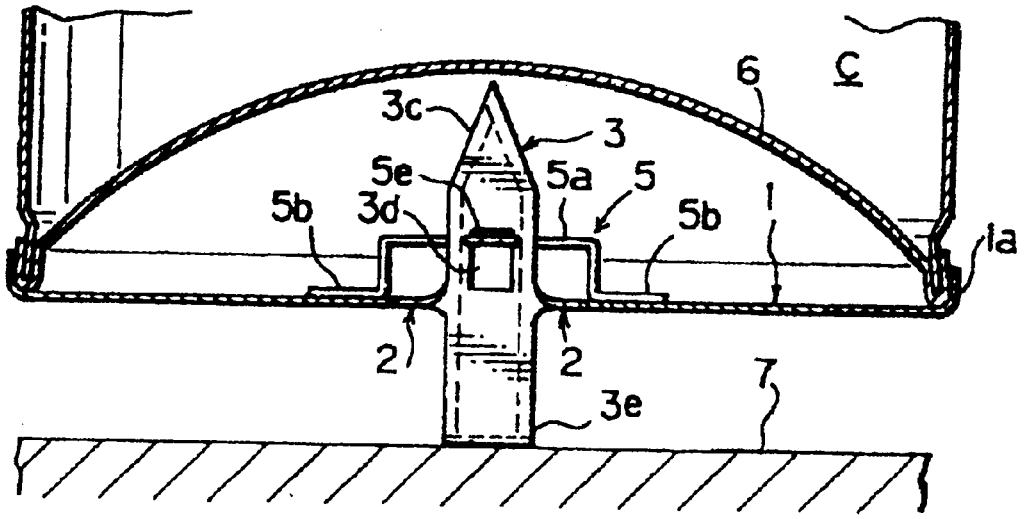
FIG. 11 (A) is a drawing showing how a gas vent hole is formed at the bottom of the can with the third embodiment.
Figure 11:
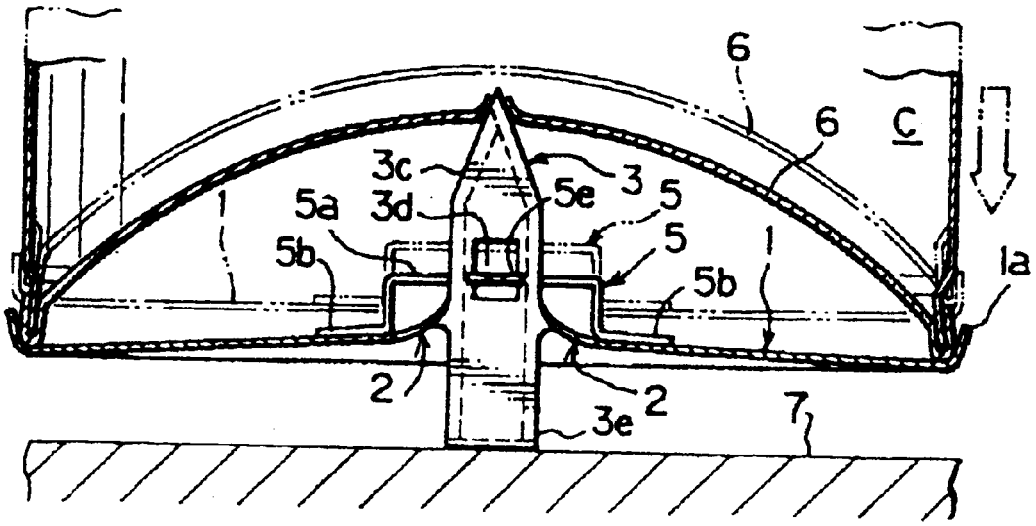

Referring to FIGS. 10 (A)–(D) and FIGS. 11 (A)–(B), in a third embodiment of the present invention, the hole-forming shaft 3*a* is absent from the hole-forming body 3. The hole-forming body 3 is formed integrally with the support plate 1 and is formed in the cut-out opening p via the twistable connecting pieces 2, 2. The end of the hole-forming body 3 is formed as a blade 3*c*, and the end opposite from the blade 3*c* is the pushing section 3*e*. A engaging hole 3*d* is formed roughly at the midpoint between the blade 3*c* and the pushing section 3*e*.

In the third embodiment, the outer perimeters of the blade 3*c*, the pushing section 3*e*, and the like are folded back to reinforce the hole-forming body 3 by increasing thickness, thus providing more rigidity. More specifically, the hole-forming body 3 is formed by forming a fold-back piece 3*f* at the perimeter. Referring to FIG. 10 (C) and (D), the fold-back piece 3*f* is folded back along the perimeter to increase the thickness along the perimeter of the hole-forming body 3. The support end-plate 5*a* of the hole-formation support 5 is formed with an engagement projection 5*e*, which slidably engages with the engaging hole 3*d*.

Figure 12:
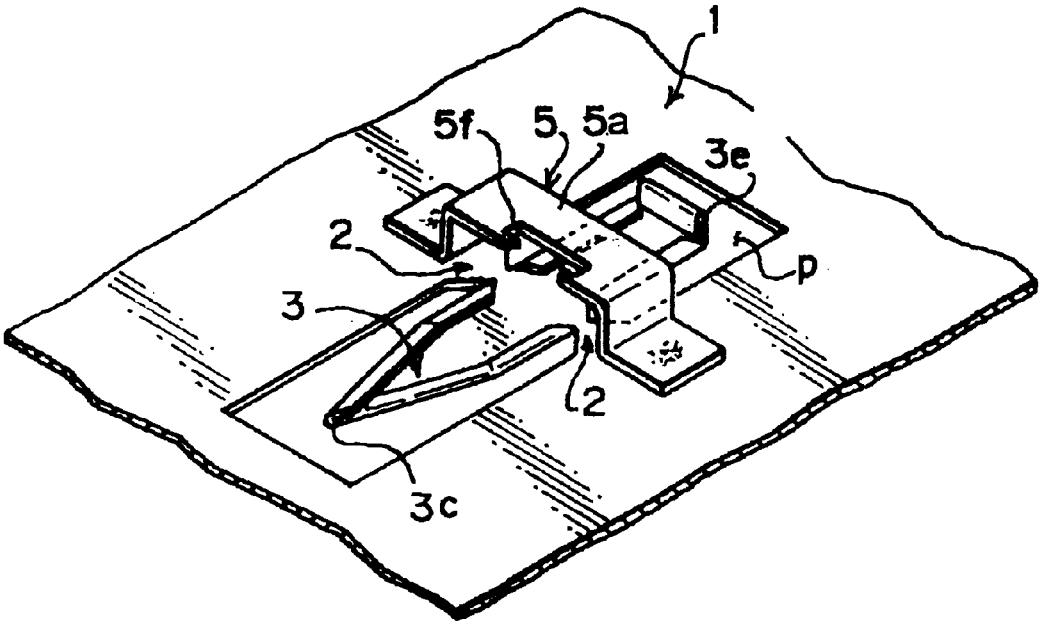
FIG. 12 (A) is an enlarged schematic perspective drawing showing an alternative example of third embodiment.
Figure 12:
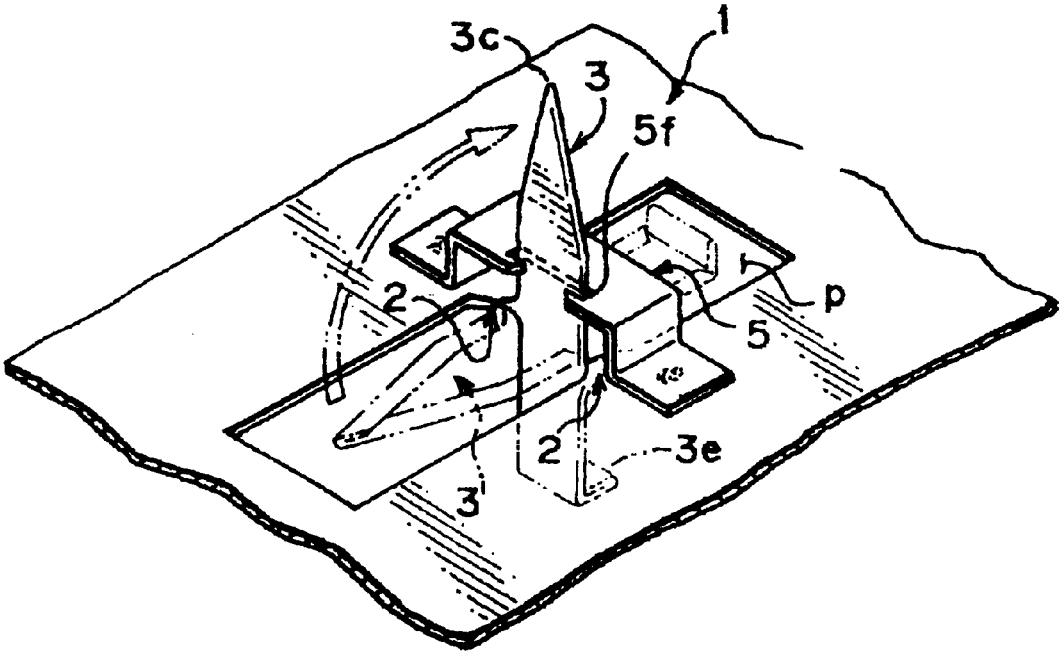

Referring to FIG. 12 (A), in an alternative example of the third embodiment, the engaging hole 3*d* is formed on the hole-forming body 3. A wide engagement opening 5*f* is formed on the support end-plate 5*a* of the hole-formation support 5.

Referring to FIG. 12 (B), when the hole-forming body 3 is raised at a roughly perpendicular orientation relative to the support plate 1, the lateral ends of the hole-forming body 3 are slidably engaged with the lateral ends of the wide engagement opening 5*f*. The second and third embodiments described above may also have the deformation section 2*a* formed on the twistable connecting piece 2, as described for the first embodiment.

Figure 13:
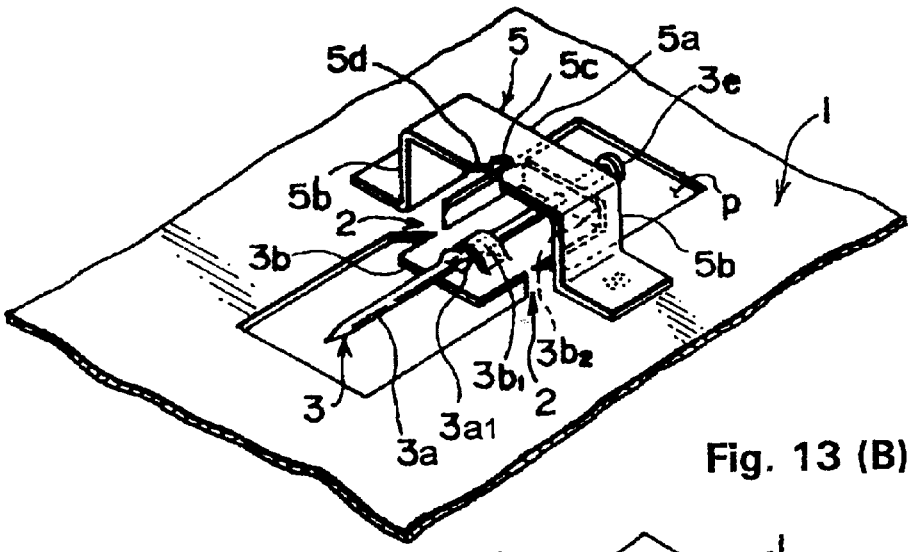
FIG. 13 (A) is a schematic perspective drawing of a hole-forming device according to a fourth embodiment.
Figure 13:
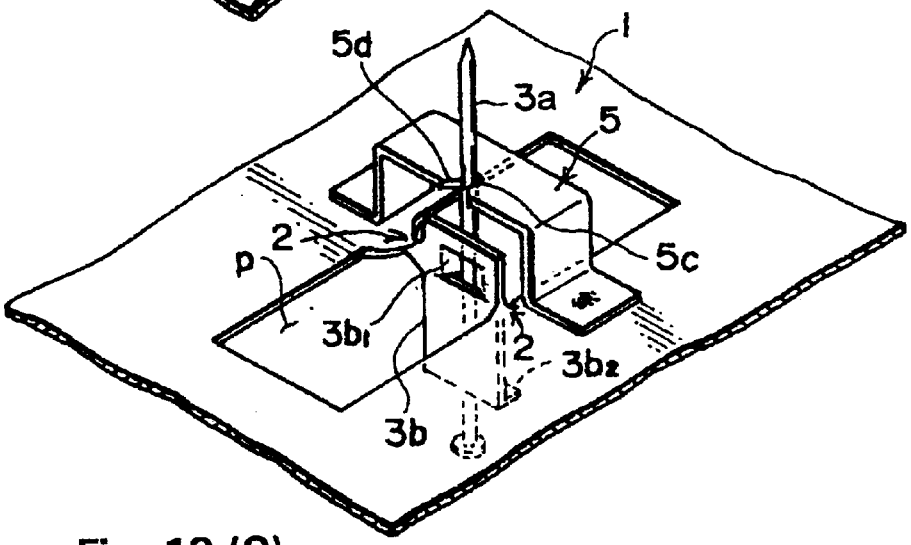
Figure 13:
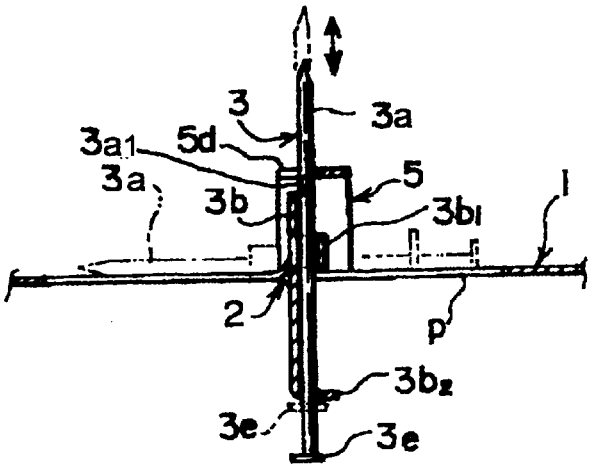

Referring to FIGS. 13 (A) through (C), the fourth embodiment of the present invention includes a hole-forming shaft 3*a* and a shaft-supporting plate 3*b* as in the first embodiment, with the hole-forming shaft 3*a* being slidable relative to the shaft-supporting plate 3*b*. The hole-forming shaft 3*a* is slidably supported by two bearings 3*b*1, 3*b*2 formed on the shaft-supporting plate 3*b*.

The bearing 3*b*1 is formed via processing means, e.g., pressing, as a half cylinder that is integral with the shaft-supporting plate 3*b*. The other bearing 3*b*2 is formed as a roughly perpendicular bend at the end of the shaft-supporting plate 3*b* to form a hole through which the hole-forming shaft 3*a* can be loosely inserted.

Referring to FIG. 13 (A), the hole-forming shaft 3*a* is inserted through the bearings 3*b*1, 3*b*2 so that it can slide relative to the shaft-supporting plate 3*b*. A stopper 3*a*1 is formed as an enlargement of the hole-forming shaft 3*a* to prevent disengagement from the bearings 3*b*1, 3*b*2. The stopper 3*a*1 is formed as a section at an appropriate position on the hole-forming shaft 3*a* that has added mass.

When the hole-forming body 3 is raised to a roughly perpendicular orientation relative to the support plate 1, the end of the hole-forming shaft 3*a* is supported by the bearing hole 5*c* of the hole-formation support 5. The other end of the hole-forming shaft 3*a* projects from the bearing 3*b*2 of the shaft-supporting plate 3*b*, and also projects from the operating side of the support plate 1. The shaft-supporting plate 3*b* is fixed to the support plate 1 via the twistable connecting pieces 2, 2, and only the hole-forming shaft 3*a* can slide along the shaft-supporting plate 3*b*.

Referring to FIG. 3 (A), the mounting side of the hole-forming device of the present invention is first mounted to the bottom 6 of the can C. Next, the hole-forming body 3 is raised to a perpendicular orientation relative to the support plate 1. The end of the hole-forming body 3 is slidably supported by the hole-formation support 5, with pointed upper end of the hole-forming body 3 facing the bottom 6 of the can C. In this state, the pushing section 3*e* of the hole-forming body 3 projects downward from the operating side of the support plate 1. The hole-forming device may also be mounted beforehand to the can C via a mounting agent.

Referring to FIG. 4 (A), the can C is positioned so that the bottom 6 is facing the floor surface 7. The pushing section 3*e* of the hole-forming body 3 is placed in contact with the floor surface 7. Referring to FIG. 3 (C), the upper portion of the can C is stepped on with a foot. This causes the pushing section 3*e* of the hole-forming body 3 to receive the reaction from the floor surface 7. Referring to FIG. 4 (B), the end of the hole-forming body 3 slides toward the bottom 6, and a gas venting hole is formed on the bottom 6.

When raised to a perpendicular orientation, the hole-forming body 3 of the hole-forming device is supported by the support plate 1 at two support positions: a lower support position via the twistable connecting pieces 2, 2; and an upper support position via the hole-formation support 5. With this support at two positions, the hole-forming body 3 is kept at a perpendicular orientation while it is slid so that the end of the hole-forming shaft 3*a* punctures the bottom 6 of the can C. This provides an efficient hole-forming operation for a gas venting hole.

This arrangement prevents the hole-forming body 3 from tipping before it punctures the bottom 6 of the can C, an event that would make it impossible to form the gas venting hole. The hole-forming device of the present invention is generally provided as part of the bottom 6 of the can C but can also be provided independently from the can C.

Figure 14:
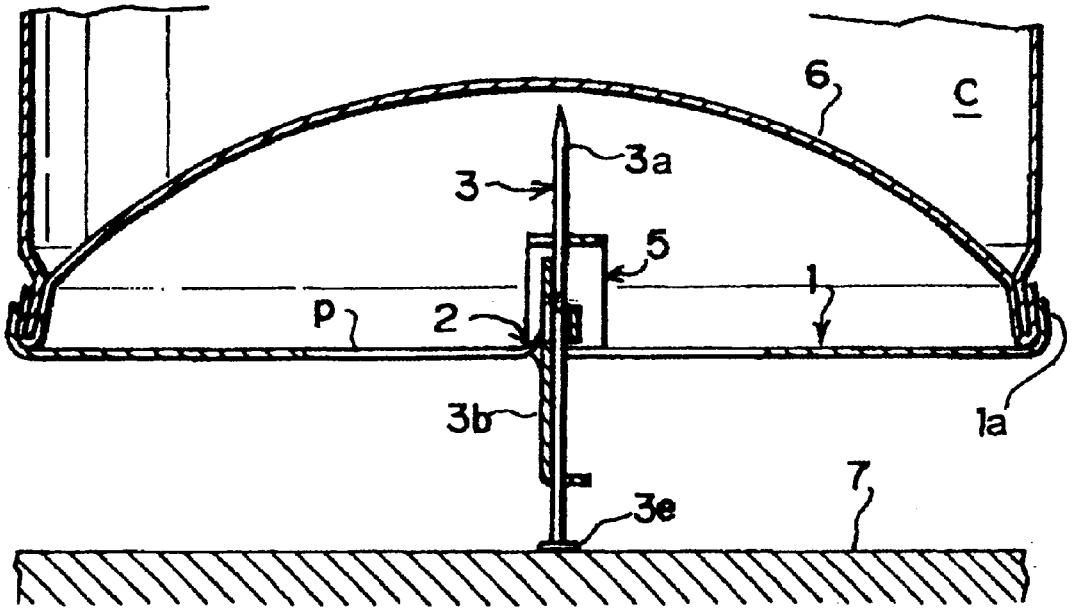
FIG. 14 (A) is a drawing showing how a gas vent hole is formed at the bottom of a can in the fourth embodiment.
Figure 14:
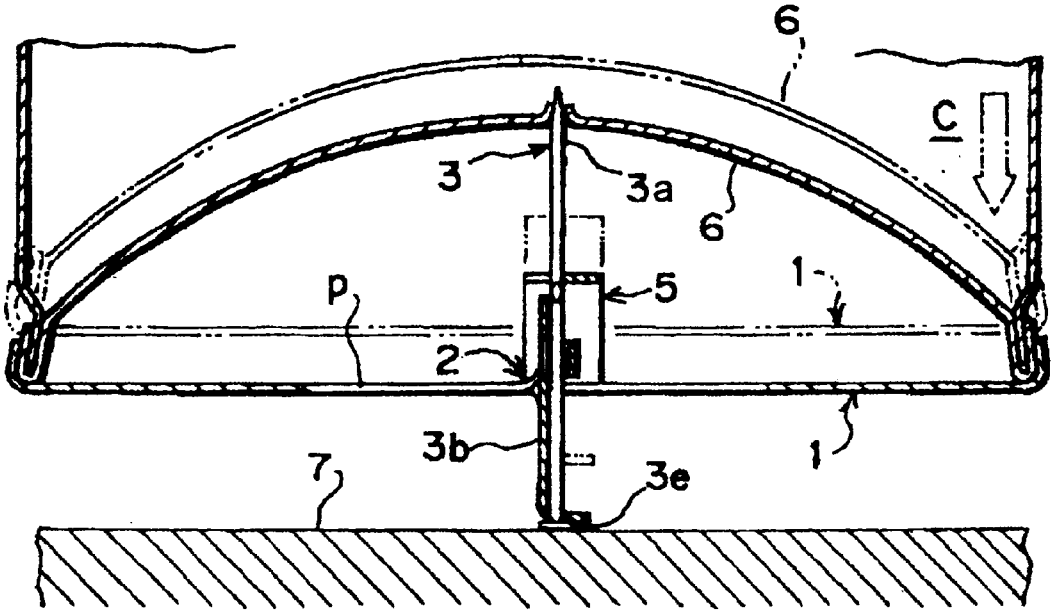

Referring to FIG. 14 (A) and (B), in the fourth embodiment of the present invention, only the hole-forming shaft 3*a* of the hole-forming body 3 slides, but the process of forming a gas venting hole in the can C is roughly identical to the method described above. The upper portion of the can C is stepped on with a foot so that the hole-forming shaft 3*a* is pressed toward the floor surface 7. The end of the hole-forming shaft 3*a* slides toward the bottom 6 to form a gas venting hole in the bottom 6.

In the invention, a support plate 1 is removable relative to a bottom of a can C and has a cut-out opening p formed at a roughly central position. A hole-forming body 3 is formed within the cut-out opening p of the support plate 1 and is capable of being raised from an orientation co-planar with the surface of the support plate 1 to a roughly perpendicular orientation. Two twistable connecting pieces 2, 2 connect the hole-forming body 3 and the support plate 1. A hole-formation support 5 slidably supports the hole-forming body 3 in a raised state at a position separated from the surface of the support plate 1. When the hole-forming body 3 is in a raised state, a lower side of the hole-forming body 3 is projected from the surface of the support plate 1. This configuration provides various advantages, including, first, that it is possible to form a gas vent hole in the can C in a safe and stable manner. Second, the structure is very simple, thus allowing the device to be provided inexpensively.

More specifically, the hole-forming body 3 can be raised in a perpendicular orientation relative to the support plate 1 via the twistable connecting pieces 2, 2. The hole-formation support 5 slidably supports the raised hole-forming body 3 at a position away from the surface of the support plate 1. The raised hole-forming body 3 is slidably supported at upper and lower positions via the twistable connecting pieces 2, 2 and the hole-formation support 5.

When the hole-forming body 3 is in a raised state, the lower side of the hole-forming body 3 projects below the lower surface of the support plate 1. By pushing the projected section, the hole-forming body 3 can slide relative to the support plate 1 while maintaining its raised state. With this structure and manner of operation, when a gas vent hole is formed by mounting the present invention to the bottom 6 of the can C, the hole-forming body 3 is able to form a gas vent hole by sliding along the perpendicular direction without instantaneous misalignment. This provides stability and safety to the operation.

Next, the shape and structure of the hole-forming device is extremely simple. Attachment can be performed by using a press or the like, making it suited for mass production and capable of being provided inexpensively. Referring to FIG. 3 (C), when a gas vent hole is formed at the bottom 6 of the can C using the hole-forming device of the present invention, the procedure can be performed simply by pushing the can C down with the bottom 6 facing down (toward the ground). Thus, gas cannot spray directly into the worker's face or body, and the procedure can be performed safely.

Next, the invention provides a hole-forming device wherein the hole-forming body 3 includes a hole-forming shaft 3*a* and a shaft support plate 3*b* to which the hole-forming shaft 3*a* is fixed. On the hole formation support 5 are disposed a bearing hole 5*c*, through which the hole-forming shaft 3*a* is inserted, and a cut-out section 5*d* having a minimum-width opening 5*d*1 that is slightly smaller than the diameter of the bearing hole 5*c*. This allows the procedure for setting up the hole-forming operation for gas vent holes to be made even easier, and the puncturing force for the hole-forming body 3 to form the gas vent hole is made greater.

More specifically, the hole-forming body 3 includes the hole-forming shaft 3*a* and the shaft-supporting plate 3*b*, thus allowing members that are suited for hole formation, such as nail-shaped members, to be used relatively easily for the hole-forming shaft 3*a*. Thus, by using a nail-shaped member or the like made from a strong material for the hole-forming shaft 3*a*, a gas vent hole can be formed for any type of can C.

Also, the hole-formation support 5 is formed with the bearing hole 5*c* and the cut-out section 5*d*. Once the raised hole-forming shaft 3*a* is inserted into the bearing hole 5*c* via the cut-out section 5*d*, which has a minimum-width opening 5*d*1 that is slightly smaller than the diameter of the bearing hole 5*c*, the hole-forming shaft 3*a* can be engaged with the hole-formation support 5 so that it cannot be easily disengaged from the minimum-width opening 5*d*1. As a result, the hole-forming shaft 3*a* of the hole-forming body 3 can slide easily while having strong inertia, which makes it extremely suited for forming gas vent holes.

Next, the invention provides a hole-forming device wherein the hole-forming body 3 includes a hole-forming shaft 3*a*, a shaft support plate 3*b* to which the hole-forming shaft 3*a* is fixed, and an engagement hole 3*d* formed on the shaft support plate. On the hole-forming shaft 3*a* is disposed an engagement projection 5*e* which is slidably engaged to the engagement hole 3*d*. With this structure the forming of gas vent holes can be performed in a stable manner with the raised state of the hole-forming body 3 relative to the support plate 1 being maintained with further rigidity.

More specifically, the shaft-supporting plate 3*b* of the hole-forming body 3 is formed with the engaging hole 3*d*, and the hole-formation support 5 is formed with the engagement projection 5*e*, which is slidably engaged with the engaging hole 3*d*. Thus, when the hole-forming body 3 is in a raised state, the shaft-supporting plate 3*b* is slidably engaged independently with the twistable connecting pieces 2, 2 and the hole-formation support 5. This provides stability for the raised state and makes the raised state more firm. As a result, the formation of the gas vent hole can be performed in a stable manner.

Next, the invention provides a hole-forming device as recited in claim 1 wherein the hole-forming body 3 is formed integrally with the support plate 1 via twistable connecting pieces 2,2. An end of the hole-forming body is formed as a blade 3*c*. An engagement hole 3*d* is formed at a position below the blade. On the hole formation support 5 is disposed an engagement projection 5*e* that is slidably engageable with the engagement hole 3*d*. As a result, the hole-forming body 3 can be formed integrally with and using the same material as in the support plate 1. This allows production to be performed simply.

Next, the invention provides a hole-forming device wherein a deformation section 2*a* is formed on the twistable connecting pieces 2,2. This provides good vertical mobility for the hole-forming body 3 and allows holes to be formed using relatively little force.

More specifically, the hole-forming device of the present invention is mounted to the bottom 6 of the can C. When an external force is applied to the hole-forming body 3 to move it toward the bottom 6, the twistable connecting piece 2 can be extended relatively easily due to plastic deformation and the like at the deformation section 2*a*. This allows the hole-forming body 3 to move easily and allows gas vent holes to be formed easily.

Next, the invention provides a hole-forming device including a support plate 1 that is removable relative to a bottom 6 of a can C and having a cut-out opening p formed at a roughly central position. A hole-forming body 3 is formed within the cut-out opening p of the support plate 1, and is capable of being raised from an orientation co-planar with the surface of the support plate 1 to a roughly perpendicular orientation. The hole-forming body 3 includes a hole-forming shaft 3*a* and a shaft support plate 3*b*. Two twistable connecting pieces 2, 2 connect the shaft support plate 3*b* and the support plate 1. A hole-formation support 5 slidably supports the hole-forming body 3 in a raised state at a position separated from- the surface of the support plate 1. The hole-forming shaft 3*a* is slidably disposed on the shaft support plate 3*b*. When the hole-forming body 3 is in a raised state, a lower side of the hole-forming shaft 3*a* is projected from the surface of the support plate 1. With this structure, the hole-forming shaft 3*a* of the hole-forming body 3 can slide relative to the shaft-supporting plate 3*b*. This allows gas vent holes to be formed with relatively little force.

More specifically, the hole-forming body 3 is slidably supported via the twistable connecting pieces 2, 2 and the hole-formation support 5. The hole-forming shaft 3*a* is slidable relative to the shaft-supporting plate 3*b*. Since gas vent holes are formed by having the hole-forming shaft 3*a* slide relative to the shaft-supporting plate 3*b*, the shaft-supporting plate 3*b* is displaced only slightly relative to the support plate 1, and there is no significant plastic deformation at twistable connecting pieces 2, 2, which support the hole-forming body 3. Thus, gas vent holes can be formed relatively easily without applying a great deal of force.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A hole-forming device comprising:

a support plate fittable to a bottom of a can;

said support plate having a cut-out opening formed therein;

a hole-forming body formed within said cut-out opening of said support plate;

deformable means for permitting raising of said hole-forming body from an orientation co-planar with the surface of said support plate to a roughly perpendicular orientation;

said deformable means including at least first and second twistable connecting pieces connecting said hole-forming body and said support plate; and a hole-formation support slidably supporting said hole-forming body in a raised state at a position separated from the surface of said support plate; and when said hole-forming body is in a raised state, a lower side of said hole-forming body projects beyond a surface of said support plate, whereby a lower part of said hole-forming body is available to receive a force effective to urge said hole-forming body upward into piercing contact with a bottom of said can.

2. A hole-forming device as recited in claim 1 wherein:

said hole-forming body includes a hole-forming shaft and a shaft support plate to which said hole-forming shaft is fixed; and a bearing hole on said hole formation support;

said hole-forming shaft being inserted through bearing hole;

said bearing hole slidably supporting said hole-forming shaft at a first position thereon;

a cut-out section having a minimum-width opening that is slightly smaller than the diameter of said bearing hole; and said hole-forming shaft being urgeable into said cut-out section, and being retained therein for slidably holding said hole-forming shaft in said raised state during said urging.

3. A hole-forming device as recited in claim 1 wherein:

said hole-forming body includes a hole-forming shaft, a shaft support plate to which said hole-forming shaft is fixed;

an engagement hole formed on said shaft support plate; and an engagement projection on said hole-forming shaft, said engagement projection being slidably engaged with said engagement hole.

4. A hole-forming device as recited in claim 1 wherein:

said hole-forming body is formed integrally with said support plate via said deformable means;

said deformable means being a twistable connecting piece;

an end of said hole-forming body being in the shape of a blade;

an engagement hole below said blade; and an engagement projection on said hole formation support; and said engagement projection is slidably ENGAGEABLE with said engagement hole.

5. A hole-forming device as recited in claim 1 wherein said deformable means includes at least one twistable connecting piece.

6. A hole-forming device according to claim 2 wherein said deformable means includes at least one twistable connecting piece.

7. A hole-forming device according to claim 3 wherein said deformable means includes at least one twistable connecting piece.

8. A hole-forming device according to claim 4 wherein said deformable means includes at least one twistable connecting piece.

9. A hole-forming device comprising:

a support plate fittable to a bottom of a can;

said support plate having a cut-out opening therein;

a hole-forming body formed within said cut-out opening of said support plate;

means for permitting said hole-forming body to be raised from an orientation co-planar with the surface of said support plate to a roughly perpendicular orientation;

a hole-forming shaft;

a shaft support plate;

two twistable connecting pieces connecting said shaft support plate and said support plate;

a hole-formation support slidably supporting said hole-forming body in a raised state at a position separated from the surface of said support plate;

said hole-forming shaft is slidably disposed on said shaft support plate; and when said hole-forming body is in a raised state, a lower end of said hole-forming shaft projects below a lower surface of said support plate.

* * * * *